US006575300B2

(12) United States Patent
Meyer et al.

(10) Patent No.: US 6,575,300 B2
(45) Date of Patent: Jun. 10, 2003

(54) BAG STACK AND METHOD OF MAKING SAME

(75) Inventors: Armin Meyer, Köln (DE); Lars Bergheim, Niederkassel (DE)

(73) Assignee: Lemo Maschinenbau GmbH, Niederkassel-Mondorf (DE)

( * ) Notice: Subject to any disclaimer, the term of this patent is extended or adjusted under 35 U.S.C. 154(b) by 0 days.

(21) Appl. No.: 09/880,704

(22) Filed: Jun. 13, 2001

(65) Prior Publication Data

US 2002/0000393 A1 Jan. 3, 2002

Related U.S. Application Data

(60) Provisional application No. 60/212,027, filed on Jun. 16, 2000.

(30) Foreign Application Priority Data

Jun. 14, 2000 (DE) ..... 100 28 589

(51) Int. Cl.[7] ..... B65D 85/62; B65D 33/14
(52) U.S. Cl. ..... 206/554; 383/9
(58) Field of Search ..... 206/554; 383/7–10, 383/37; 493/189, 210

(56) References Cited

U.S. PATENT DOCUMENTS

| | | | | |
|---|---|---|---|---|
| 4,759,639 A | * | 7/1988 | DeMatteis | 206/554 |
| 4,903,839 A | * | 2/1990 | Mattiebe et al. | 206/554 |
| 4,981,216 A | * | 1/1991 | Wilfong, Jr. | 206/554 |
| 5,226,858 A | | 7/1993 | Snowdon | |
| 5,348,399 A | * | 9/1994 | DeMatteis | 206/554 |
| 5,497,884 A | * | 3/1996 | DeMatteis et al. | 206/554 |
| 6,068,128 A | | 5/2000 | Gardner | |
| 6,116,424 A | * | 9/2000 | Leu | 206/554 |
| 6,269,950 B1 | * | 8/2001 | Nquyen | 206/554 |

FOREIGN PATENT DOCUMENTS

| | | |
|---|---|---|
| DE | 37 04 662 | 8/1988 |
| DE | 199 16 646 | 10/2000 |

* cited by examiner

*Primary Examiner*—Jim Foster
(74) *Attorney, Agent, or Firm*—Herbert Dubno

(57) ABSTRACT

A stack of plastic foil bags has a flap projecting beyond a filling opening on one broad side of the each bag which has a corner region delimited by perforations and formed in the corner region with at least one interlocking point for joining the bags in the stack and a stack-incorporation means separate from the interlocking point and enabling assembly of the bags into the stack.

7 Claims, 5 Drawing Sheets

BAG STACK AND METHOD OF MAKING SAME

CROSS REFERENCE TO RELATED APPLICATION

This application is related to copending provisional application No. 60/212,027 filed Jun. 16, 2000, and is a nonprovisional application replacing the provisional application.

FIELD OF THE INVENTION

Our present invention relates to a stack of multiple plastic foil bags and to a method of making that stack. More particularly, the invention relates to bags of the type which are used with automatic packaging machines and in bags which are individually pulled from the stack and separate along perforation lines from a bag residue which remains as part of the stack.

BACKGROUND OF THE INVENTION

In the continuous production of bags it is generally known to collect the bags which are made together to form stacks or pads each with a predetermined number of bags. The collection device can be, for example, a pin-type stacking conveyor with a horizontally-moving conveyor chain carrying pins on which the individual bags are stacked. Openings are stamped or punched into the bag at distances corresponding to the spacing of a pair of stacking pins and the bags are placed over those pins by threading the pins through the openings.

It is also known to hold bags of a stack together by means of a wire bracket which has its shanks traversing the openings formed in a flap part of the bag. For this purpose the bag stack can be lifted from the stacking pins of the pin-type stacking conveyor and placed over the shanks of the wire bracket or the shanks of the wire bracket can be inserted through the holes in the stacked bags to allow the wire bracket to be used to remove the stacks from the pins.

The ends of the wire bracket can bear upon front and rear cover sheets which are provided between the bracket ends and the plastic bags and the stack can be secured by safety plates or rubber plugs fitted onto the shanks of the wire brackets. The steps involved are usually performed manually by an operator.

Mention should be made of the fact that such bags are generally provided with unilateral flaps and the suspension holes are customarily provided in those flaps. The term "unilaterally" is used to indicate that the flap is generally an extension or provided as a separate part of one of the broad walls of the bag, the other broad wall terminating at an edge which can be pulled away from the first-mentioned broad wall to form the filling opening of the bag. The bag stacks hitherto provided are expensive because of the need for auxiliary materials, like the wire stirrup and the front and rear cover sheets or the plates or plugs. Furthermore, the bag stacks themselves are difficult to package and transport largely because of the presence of the wire stirrup. When product is to be introduced into the bag in an automatic-packaging machine, the flap part is usually turned off along the bag opening and can result in a sloppy appearance of the bag since the front edge is no longer smooth. In some cases, moreover, the wire bracket or stirrup must be returned to the manufacturer for recycling.

It is also known, in the production of bag stacks, to interlock the bags by pressing one of the bags into the other at interlocking points at the corners, usually of flaps of the type described. The interlocking approach simplifies the packaging of the bags and makes the separation of the bags from the stack somewhat neater and frequently simplifies bag production. There is no need for the brackets and stirrups and thus the manufacturing and handling of the stacks can be more cost-effective, especially since the cost of the wire brackets and of their return to the manufacturer of the bags is eliminated.

Nevertheless the production of stacks of bags is capable of improvement.

OBJECTS OF THE INVENTION

It is the principal object of the present invention to provide an improved bag stack which ensures a more aesthetic appearance of the bags after separation from the stack and more economical fabrication of the stack than has been the case hitherto.

Another object of the invention is to provide an improved method of making a bag stack, particularly for use in the machine packaging of goods.

Still another object of the invention is to provide a method of stacking plastic bags of film or foil whereby drawbacks of earlier bag stacks are avoided and, in addition, to provide an improved bag stack with the advantages gained by that method.

SUMMARY OF THE INVENTION

These objects and others which will become apparent hereinafter are attained, in accordance with the invention in a bag stack formed from bags having a unilateral flap which is provided in corner regions with separating lines of perforations and within the corner region, the means for retaining the bags in a stack, e.g. the hole along the margins of which the bags of the stack can be held together.

According to the invention, within the corner region bounded by the perforations and thus within the tear-off segments of the flap, a means for incorporating the bags in the stack can be provided, for example, in the form of cross-shaped or star-shaped seal arrangements.

According to the invention, the bag flap is placed over a stack of pins of the collection device so that the collection is hugged by the lobes separated by the cross-shaped or star-shaped array of slits and, once the stack is formed on these pins, the bags of the stack are held together, also within the corner region delimited by the perforations.

The star-shaped or cruciform array of slits, referred to here as the means for stack incorporation, are arranged in corner areas of the flap delimited by the perforations and thus in a pair of segments which remain behind when the remainder of the flap is separated from the corner segments but stack-incorporation means of this type has precisely defined contours which snugly grip the stacking pins by the lobes which are spread apart as the stacking corporation means are forced over the pins. The result is an optimal suspension of the individual bags on the pin and support for the bags as they are padded together.

Another advantage of the provision of the slit arrays within the corner areas delimited by the perforations and of providing the actual attachments of the bags together in these areas, is that the bag can be separated from the two corner segments which remain on the stack significantly more neatly than has been the case.

Furthermore, the system of the invention provides a central area of the flap between the perforations which is free from discontinuities, holes, slits and the like and which can be used to receive print, for labeling or the like, without disturbance resulting from such discontinuities.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
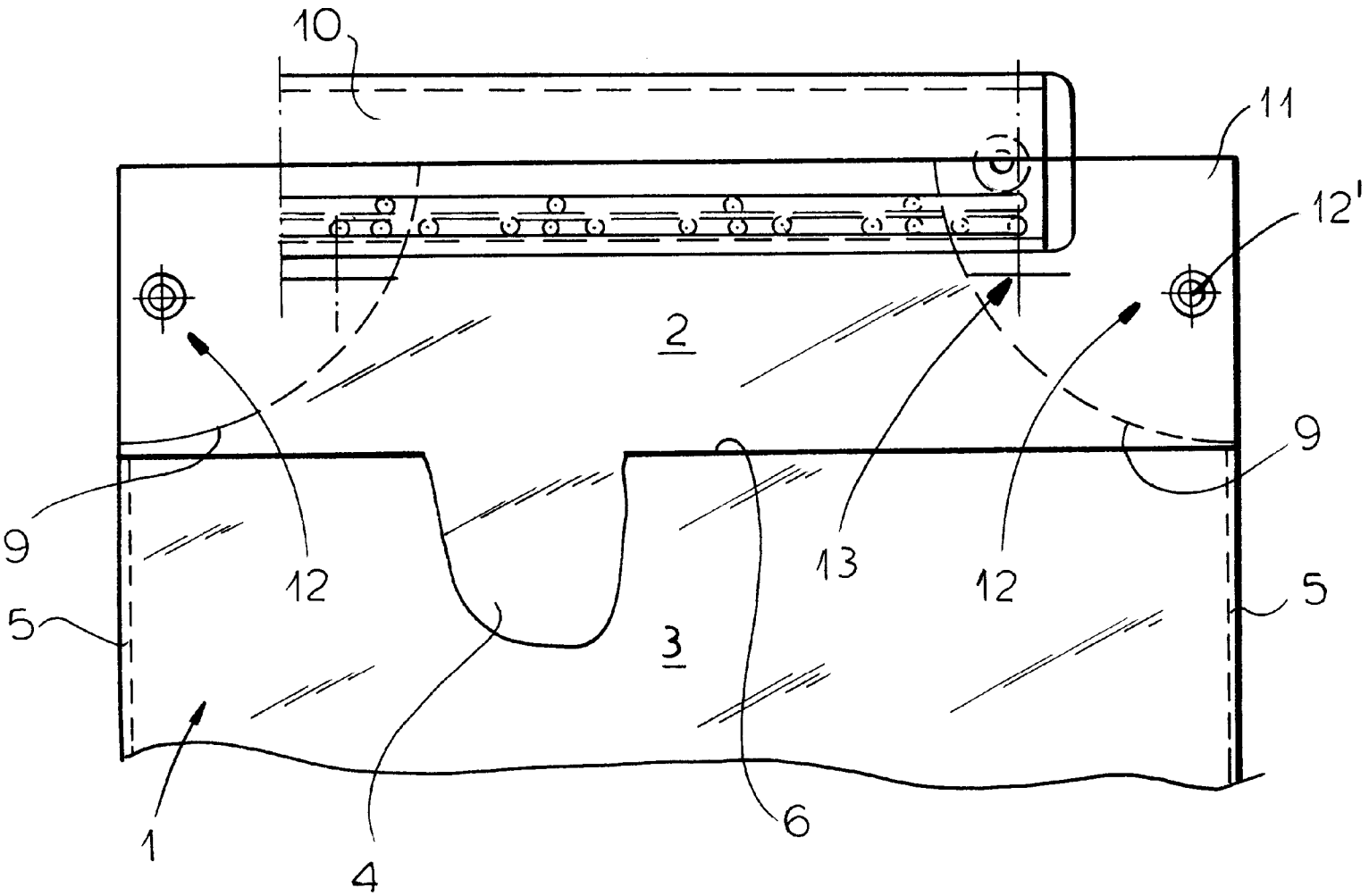
FIG. 1 is a partial top view of a bag stack showing a part of a machine for handling the bag forming the bag stack.

Each bag 1 of a bag stack (FIG. 1) can be formed with broad sides 3 and 4, the latter of which is extended into a flap 2 beyond the edge 6 of the other flap 3 and thus with a so-called unilaterally-projecting flap. The edge 6 forms a mouth of the bag at which the bag can be opened to insert an article or goods in an automatic packaging machine. The corner areas 11 of the flap 2 form tear-off segments and are delimited by ark-shaped perforation lines 9. In each of these segments there is an interlocking point 12 at which the bags are fused together and each interlocking point 12 can have a hole 12' which can support the stack of bags on a pair of pins to enable the individual bags to be torn away. The broad sides 3 and 4 are joined together by weld seams 5 along opposite edges of the bag and the bottom of the bag (not shown) may be similarly seamed or gusseted or simply provided as a portion of the plastic foil or film which has been folded to form the two broad sides 3, 4, one overlying the other.

Figure 3:
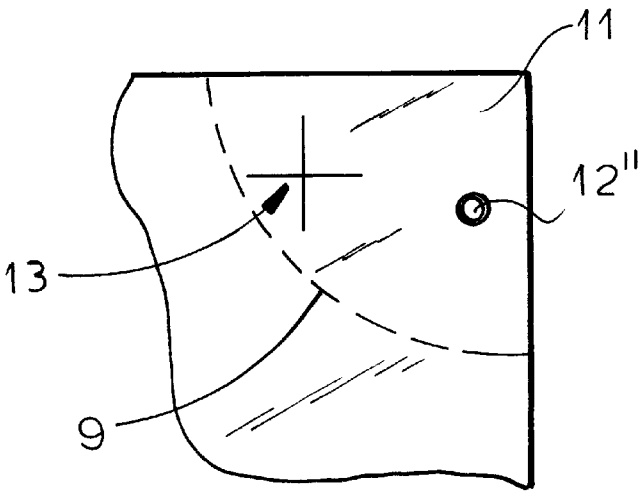
FIG. 3 is a view of a portion of a bag in accordance with another embodiment of the invention.

In the embodiment of FIG. 3 the interlocking point is formed as a spot-weld 12" joining the flaps 2 together.

Each of the flaps 2 is additionally formed with a so-called stack-incorporation means 13 in the form of a cruciform pattern of slits. This cruciform pattern may also be referred to as a star pattern of slits. The slits are located in the tear-off segments 11, preferably adjacent the respective perforation line 9. The slits permit the bags to be collected on a collection device and to be suspended in stacked relationship prior to interlocking via the interlocking points 12. The interlocking points 12 can be located in the tear-off regions 11 close to edges of the bag.

Figure 2:
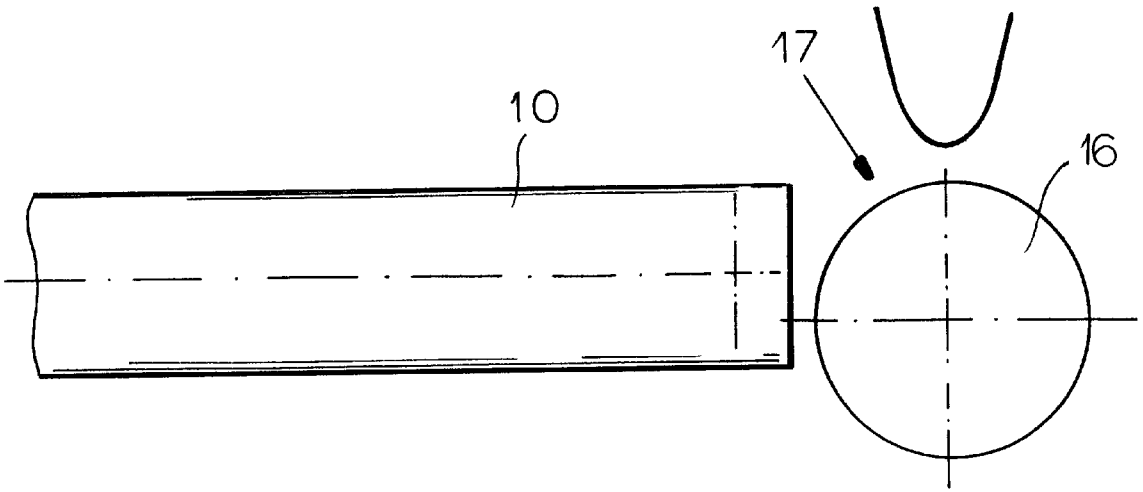
FIG. 2 is a diagram illustrating a further part of the machine.

The interlocking points are so provided that suction arms 10 (FIGS. 1 and 2) can grip and support the stack for transferring the same. Because the transfer devices 10 can engage the flap inwardly of the points 12, the fusion roller 16 of the transverse fusion-separating device 17 can have a smaller diameter usually about 50 mm, than is conventionally used.

Figure 4:
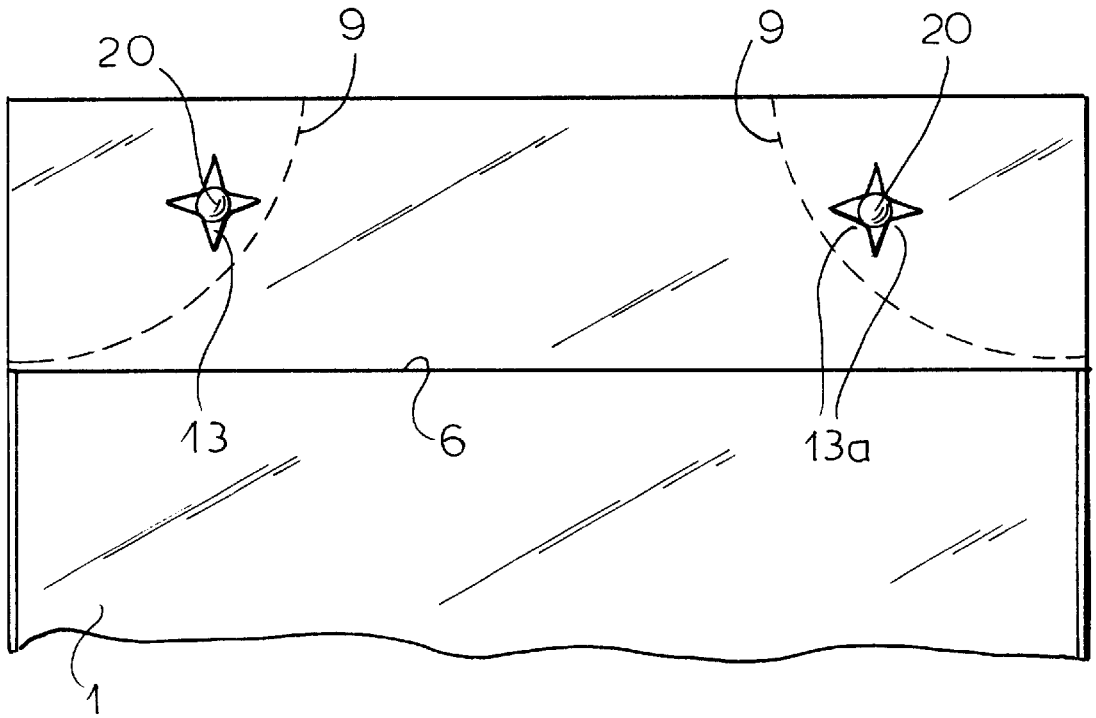
FIG. 4 is a view of the stack-forming step similar to FIG. 1 and prior to the bonding of the bags together.
Figure 5:
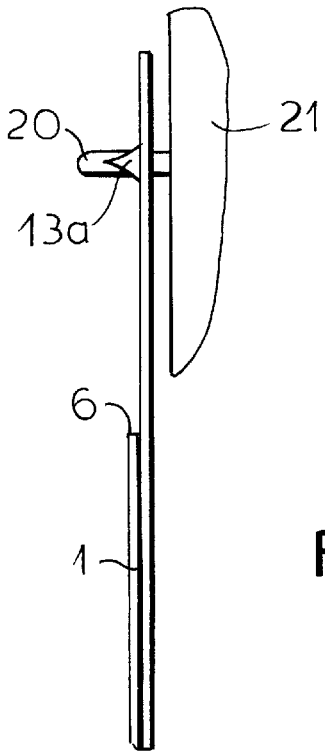
FIG. 5 is a top view corresponding to FIG. 4.

As can be seen from FIGS. 4 and 5, before the fusion points 12, 12" are formed, the slit portion 13 is engaged by the pins 20 of the stacking unit 21, usually the stacking conveyor, with the lobes 13*a* between the slits being spread by the pin and hugging the respective pin (compare FIGS. 4 and 5).

Figure 6:
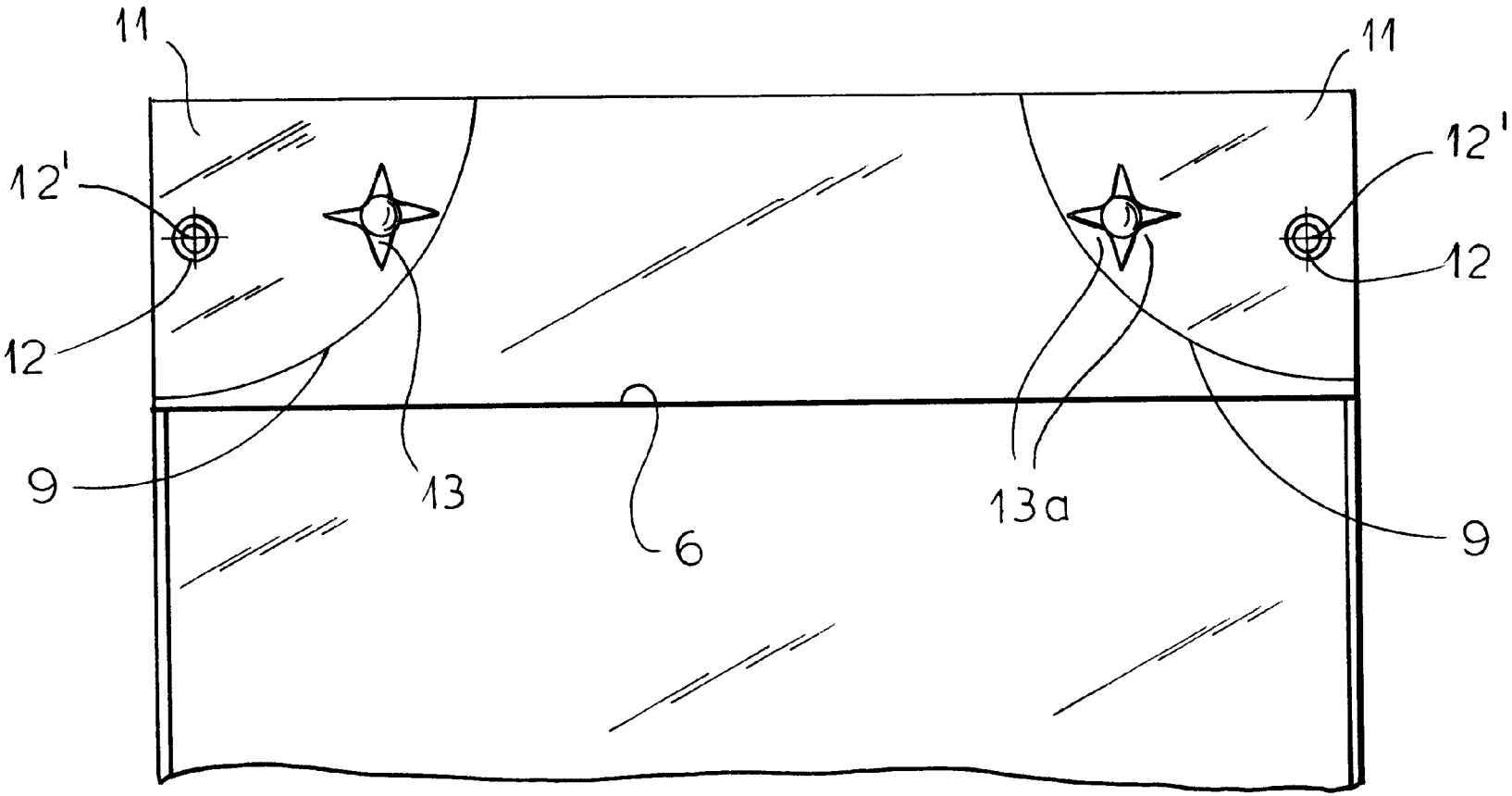
FIG. 6 is a view similar to FIG. 4 after the bonding of the bags into the stack.
Figure 7:
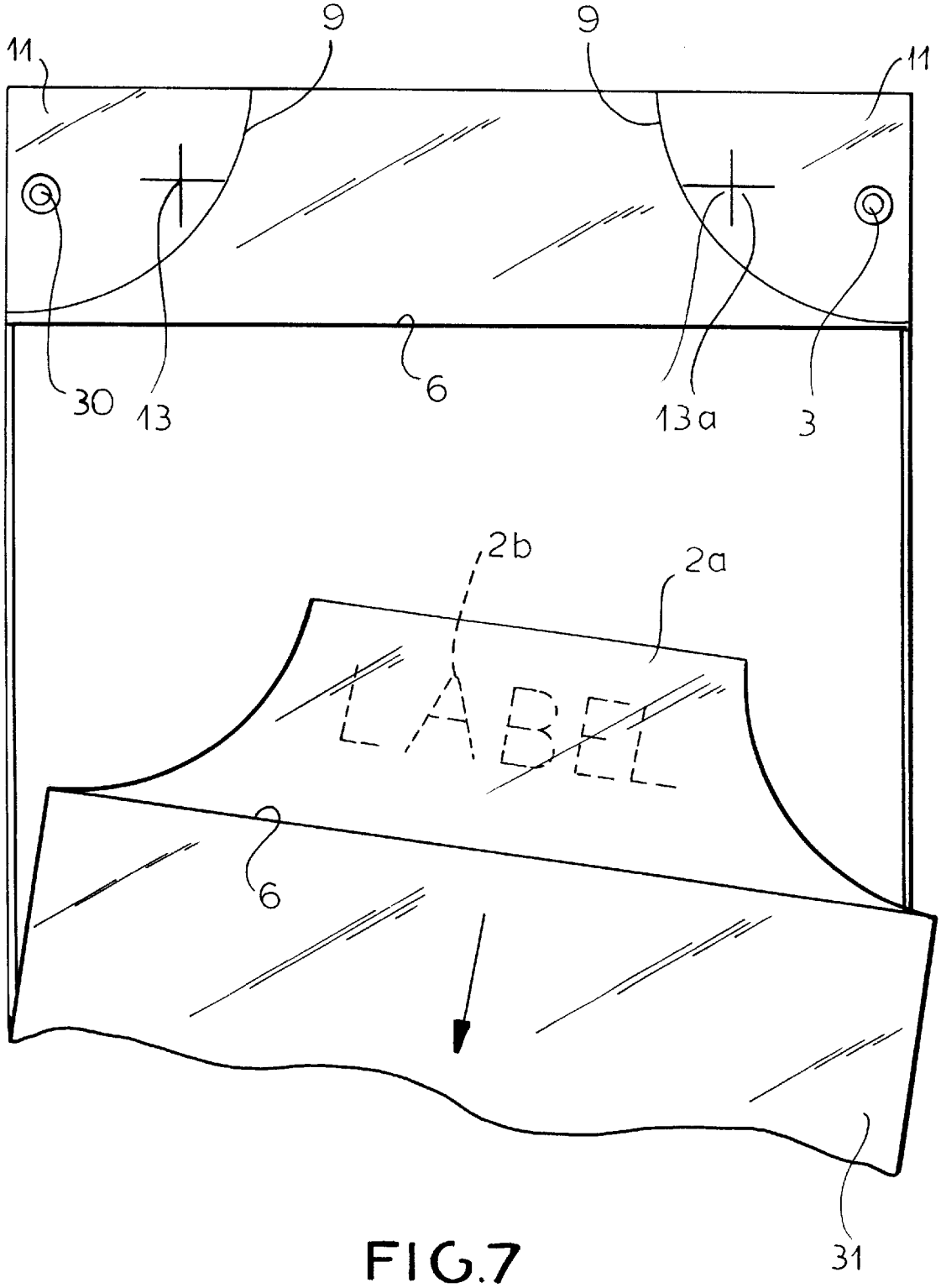
FIG. 7 is a view showing the tearing of a bag from the stack.

In use on the automatic packaging machine (compare FIGS. 6 and 7), to fill the individual bag with, for example, a bread loaf, the article is introduced into the filling opening formed at the edge 6 and while the segments 11 are held by for example, further pins 30 of the automatic packaging machine or by clamping at the corner regions, each uppermost bag is torn off along the perforation lines leaving the corner segment on the pin 30 while the bag 31 is shifted to a closing device. As can be seen from FIG. 7, the central flap region 2*a* which is torn from the corner segments, can have a printed field 2*b* since it is free from discontinuities.

We claim:

1. A method of producing a stack of plastic foil bags each of which comprises a flap projecting beyond a filling opening on one broad side of the respective bag, each of said bags having a corner tear-off segment formed by a region delimited by a row of perforations and formed in said corner region with at least one interlocking point joining said bags in said stack and a stack-incorporation means separate from said interlocking point and enabling assembly of said bags into said stack, said method comprising the steps of:

folding a plastic foil web to provide broad surfaces of respective bags with flaps extending from one of the broad surfaces;

perforating corner portions of said flaps to form tear-off segments along an arcuate perforation line;

forming cross-slits in each of said tear-off segments near the respective perforation line;

engaging pins in said slits to stack said bags together; and securing the stacked bag together within the tear-off segments.

2. A stack of plastic foil bags each having a flap projecting beyond a filling opening on one broad side of the respective bag, each of said bags having corner regions of the respective flap delimited by an arc-shaped row of perforations and being formed in the respective corner region with at least one interlocking point joining said bags in said stack and a stack-incorporation means separate from said interlocking point for enabling assembly of said bags into said stack and disposed close to the respective row of perforations said stack-incorporation means being each located at an inwardly pointing area of the respective corner region.

3. The stack defined in claim 2 wherein said stack-incorporation means are offset toward the outer margin of the respective flap with respect to a median line connecting the interlocking points.

4. The stack defined in claim 2 wherein said stack-incorporation means include holes punched through said bags.

5. The stack defined in claim 2 wherein said stack-incorporation means are cross slits.

6. A stack of plastic foil bags each having a flap projecting beyond a filling opening on one broad side of the respective bag, each of said bags having a corner region delimited by a row of perforations and formed in said corner region with at least one interlocking point joining said bags in said stack and a stack-incorporation means in the form of slits separate from and inwardly of the respective interlocking point and enabling assembly of said bags into said stack.

7. The stack defined in claim 4 wherein said stack-incorporation means are cross slits.

* * * * *